US011385037B2

(12) United States Patent
Hwang

(10) Patent No.: US 11,385,037 B2
(45) Date of Patent: Jul. 12, 2022

(54) ELECTRONIC DETONATION DEVICE WITH DUAL ANTENNA FOR BLASTING SYSTEM AND BLASTING SYSTEM USING SAME

(71) Applicant: HANWHA CORPORATION, Seoul (KR)

(72) Inventor: Ki Won Hwang, Cheongju-si (KR)

(73) Assignee: HANWHA CORPORATION, Seoul (KR)

( * ) Notice: Subject to any disclaimer, the term of this patent is extended or adjusted under 35 U.S.C. 154(b) by 0 days.

(21) Appl. No.: 17/252,479

(22) PCT Filed: Dec. 4, 2020

(86) PCT No.: PCT/KR2020/017589
§ 371 (c)(1),
(2) Date: Dec. 15, 2020

(87) PCT Pub. No.: WO2021/118166
PCT Pub. Date: Jun. 17, 2021

(65) Prior Publication Data

US 2021/0172718 A1 Jun. 10, 2021

(30) Foreign Application Priority Data

Dec. 10, 2019 (KR) ..... 10-2019-0164041

(51) Int. Cl.
*F42D 1/055* (2006.01)
*F42C 13/04* (2006.01)

(52) U.S. Cl.
CPC ..... *F42D 1/055* (2013.01); *F42C 13/047* (2013.01)

(58) Field of Classification Search
CPC ..... F42C 13/04; F42C 13/045; F42C 13/047; F42D 1/045; F42D 1/05; F42D 1/055
See application file for complete search history.

(56) References Cited

U.S. PATENT DOCUMENTS 1,757,288 A * 5/1930 Bleecker ..... F42D 1/05 102/322
2,507,351 A * 5/1950 Scherbratskoy ..... E21B 47/13 340/854.6
3,978,797 A * 9/1976 Harrington ..... F42C 13/02 102/214

(Continued)

FOREIGN PATENT DOCUMENTS

CN 101995196 A 3/2011
JP 6514357 B2 5/2019

(Continued)

*Primary Examiner* — Bret Hayes
(74) *Attorney, Agent, or Firm* — WHDA, LLP

(57) ABSTRACT

An electronic detonation device with a dual antenna for a blasting system is proposed. The electronic detonation device includes: an electronic detonator; a wireless communication module, and a wire part connecting the electronic detonator to the wireless communication module. The wireless communication module includes a first antenna part positioned in an upper portion therein and a second antenna part positioned in a lower portion therein. Accordingly, regardless of a placement direction of the wireless communication module on the ground, stable wireless communication is performed, thereby improving blasting accuracy.

10 Claims, 7 Drawing Sheets

(56) References Cited

U.S. PATENT DOCUMENTS

| | | | | |
|---|---|---|---|---|
| 4,656,944 | A * | 4/1987 | Gonzalez | E21B 1/00 102/202 |
| 6,820,693 | B2 * | 11/2004 | Hales | E21B 43/1185 166/297 |
| 9,523,271 | B2 * | 12/2016 | Bonavides | E21B 47/13 |
| 2016/0003599 | A1 | 1/2016 | Hikone et al. | |
| 2018/0231361 | A1 | 8/2018 | Wicks et al. | |
| 2018/0356188 | A1 * | 12/2018 | Maxwell | F41G 7/2293 |
| 2019/0107374 | A1 * | 4/2019 | Hill | F42B 12/46 |

FOREIGN PATENT DOCUMENTS

| | | | | |
|---|---|---|---|---|
| KR | 10-0150333 | B1 | 11/1998 | |
| KR | 10-2015-0104134 | A | 9/2015 | |
| WO | 1994/015411 | A1 | 7/1994 | |
| WO | WO-0159401 | A1 * | 8/2001 | F42D 1/05 |
| WO | WO-2004005840 | A1 * | 1/2004 | F42C 13/04 |
| WO | 2018/202953 | A1 | 11/2018 | |

* cited by examiner

【FIG. 1】
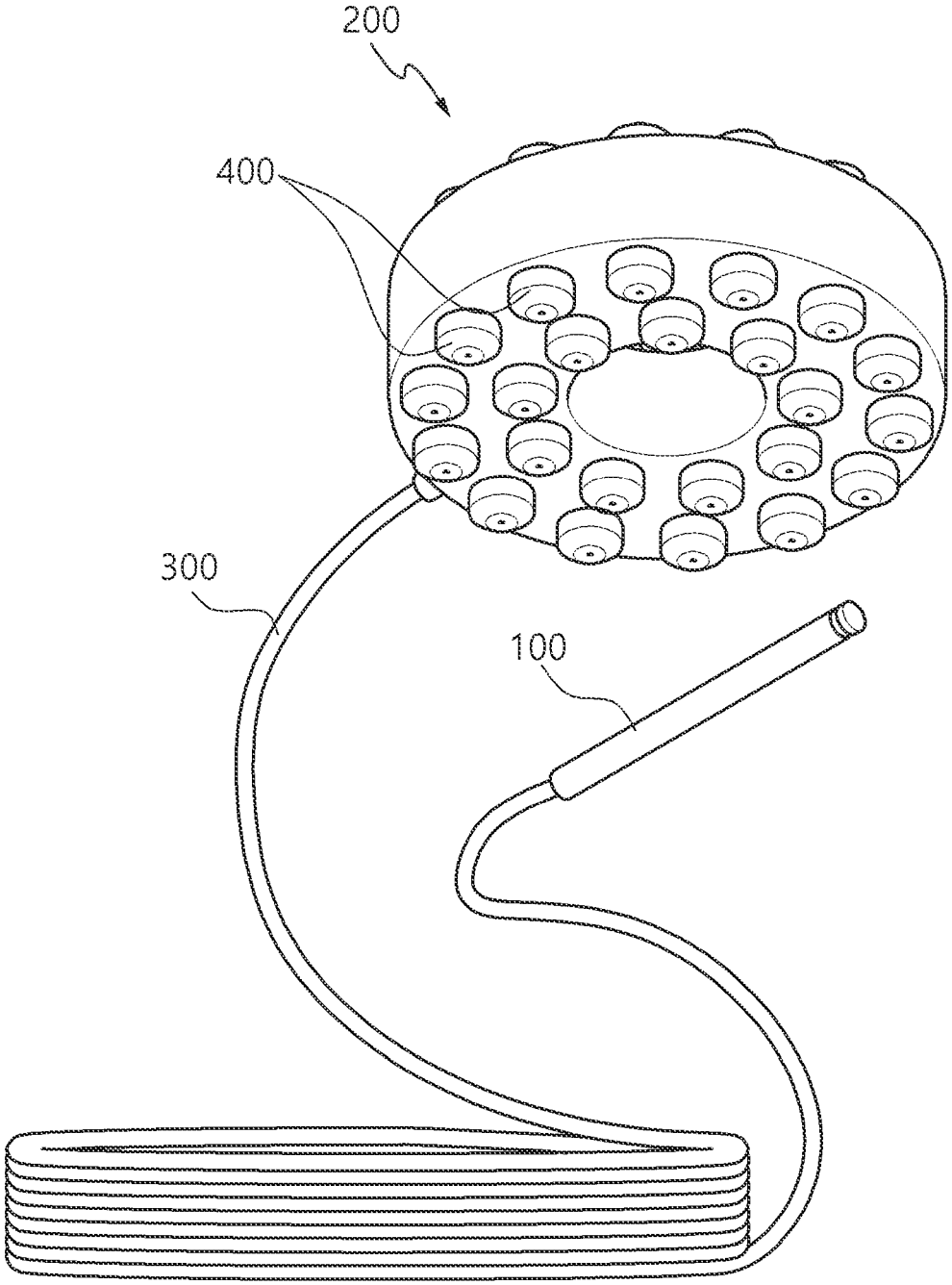

【FIG. 2】
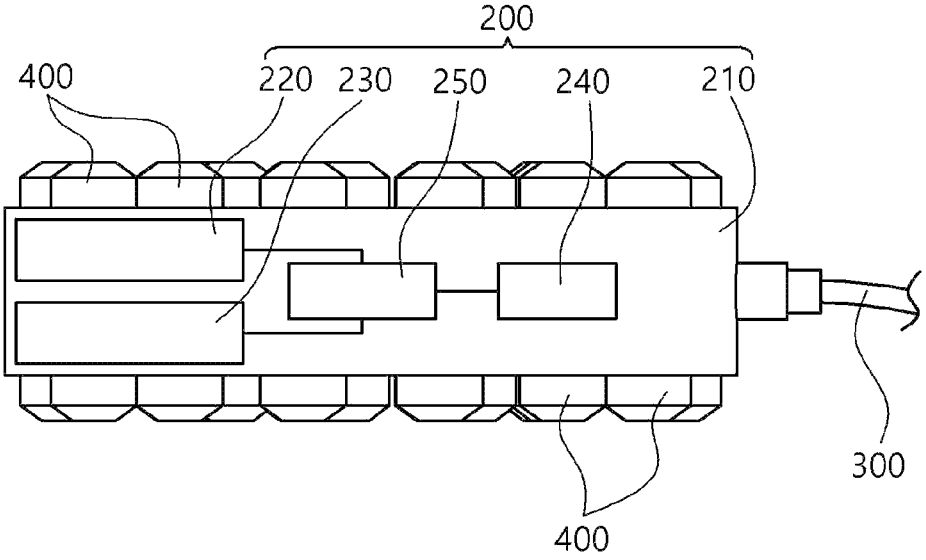

【FIG. 3】
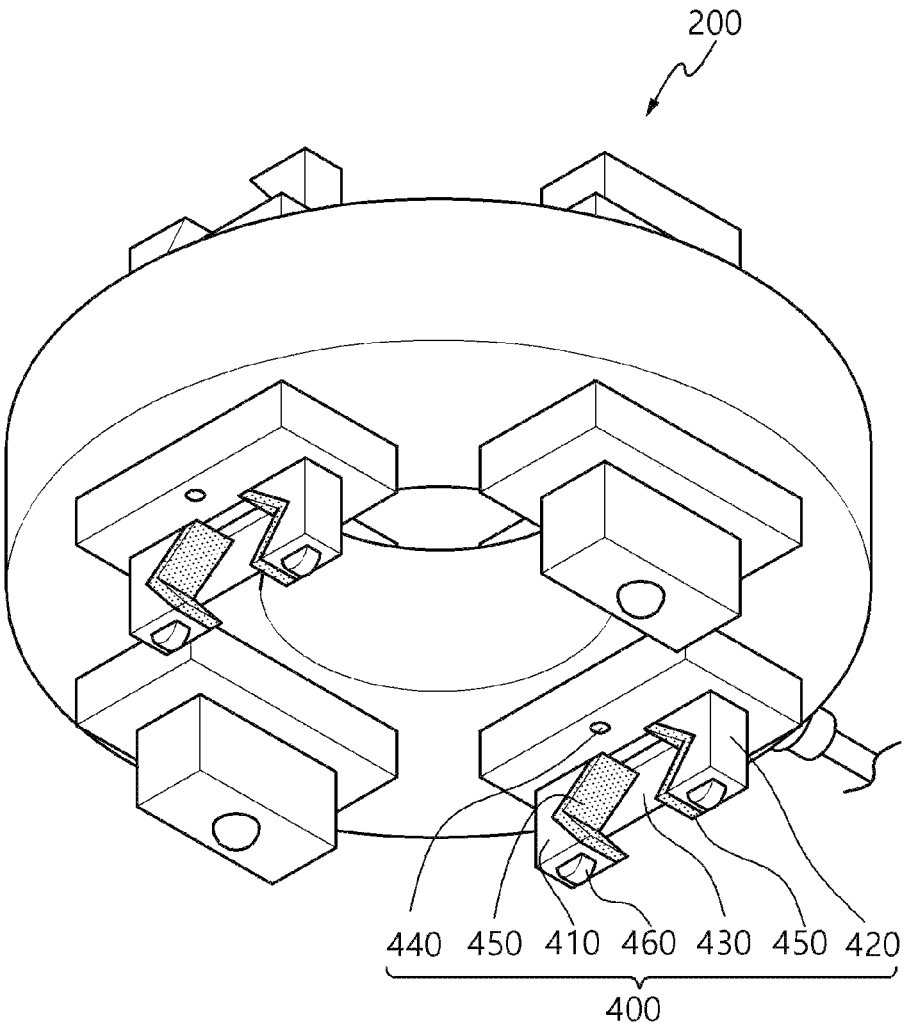

【FIG. 4】
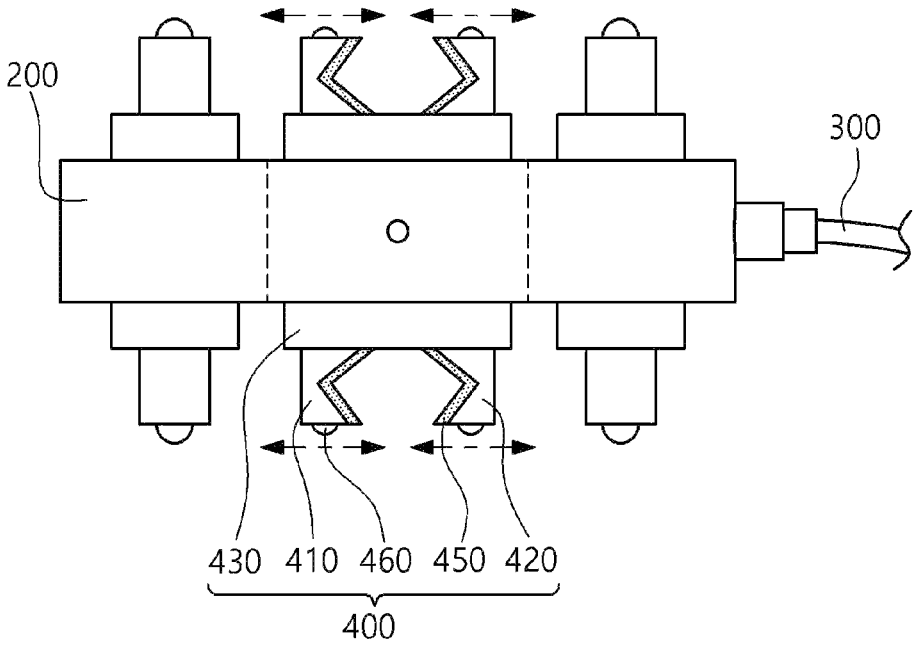

【FIG. 5】
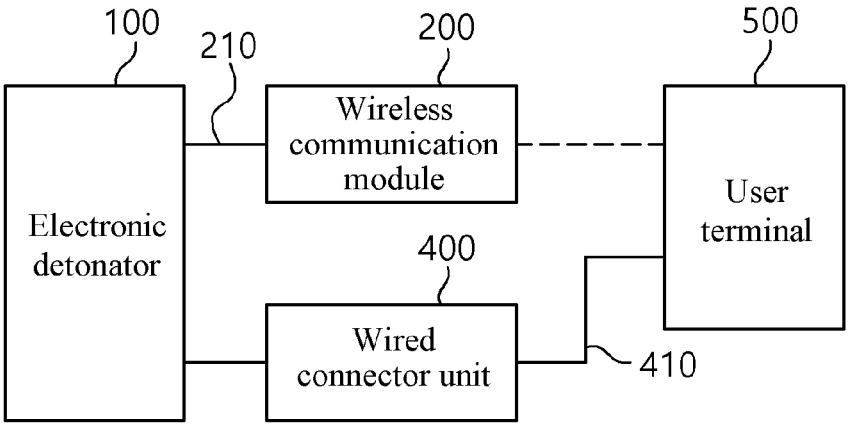

【FIG. 6】
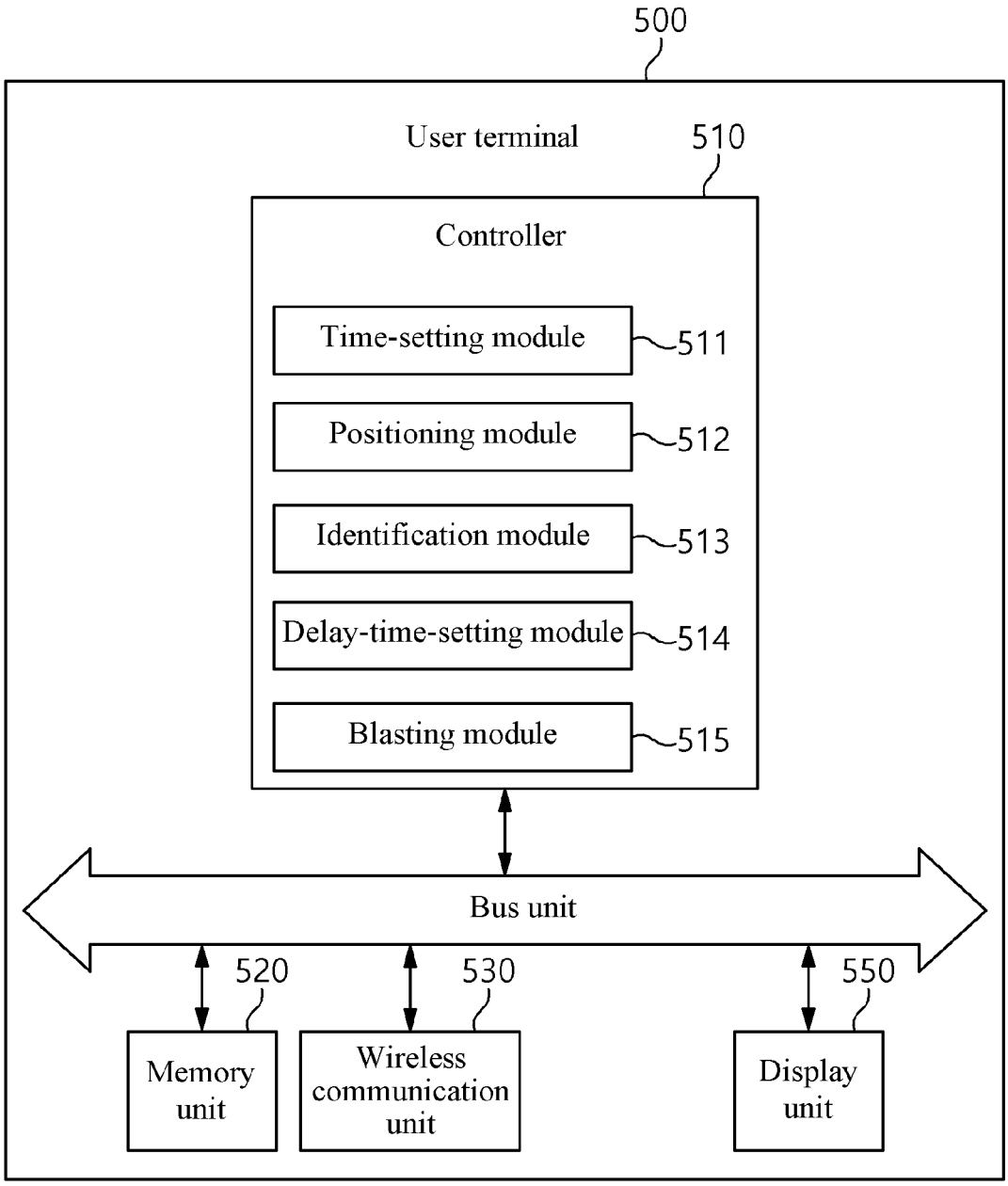

【FIG. 7】
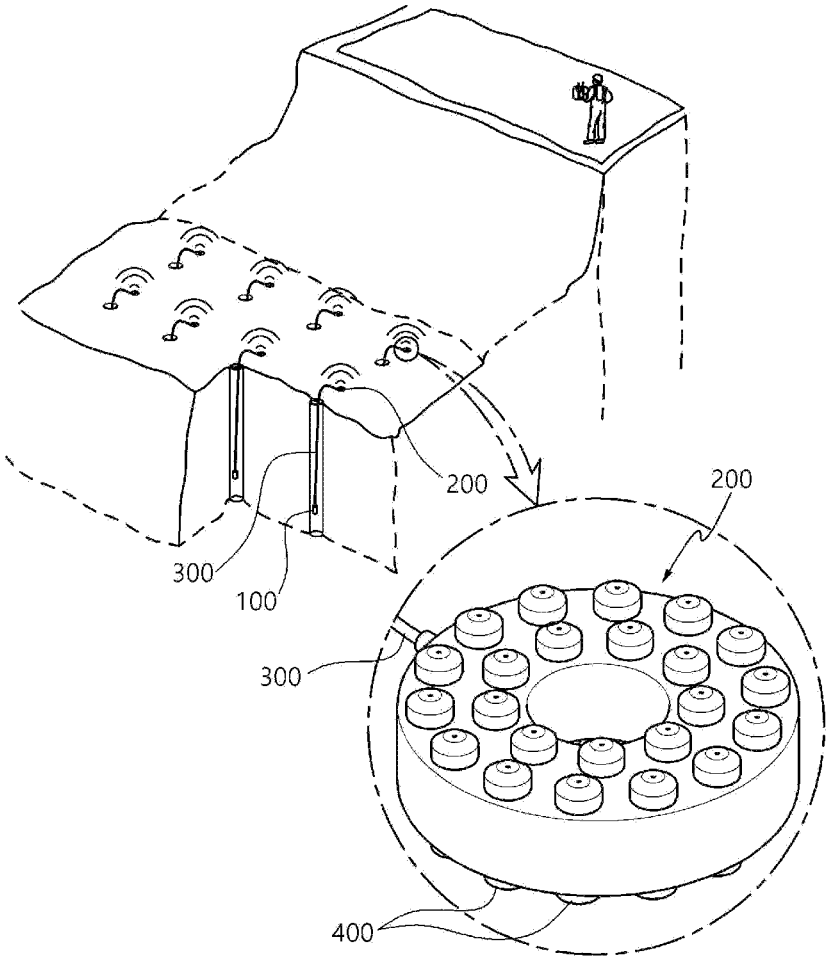

ELECTRONIC DETONATION DEVICE WITH DUAL ANTENNA FOR BLASTING SYSTEM AND BLASTING SYSTEM USING SAME

TECHNICAL FIELD

The present disclosure relates to an electronic detonation device with a dual antenna for a blasting system and a blasting system using the same and, more particularly, to an electronic detonation device with a dual antenna for a blasting system and a blasting system using the same, wherein the electronic detonation device has a wireless communication module with an antenna positioned in each of an upper portion and a lower portion of the wireless communication module to secure stable communication reliability.

BACKGROUND ART

In general, explosives are used in engineering work, such as rock blasting for tunnel construction and building demolition. In particular, a plurality of holes, into which explosives are to be inserted, is drilled corresponding to the sections of a blasting target, i.e. the object to be blasted.

After an explosive is inserted into each of the drilled holes, the explosives are connected to a user terminal.

The explosives are exploded by operating the user terminal, thereby blasting the blasting target.

As a detonation device for explosives, a wireless-communication-type detonation device or a wired-communication-type detonation device may be used.

Conventionally, an electronic detonation device using wireless communication includes an electronic detonator, a wireless communication module, and wires connecting the wireless communication module to the electronic detonator.

The wireless communication module has an antenna therein for wireless communication provided to communicate with a user terminal.

After the electronic detonator is positioned to be inserted into the ground, the wireless communication module is placed on the ground. When an antenna-positioned surface of the wireless communication module is placed on the ground, radio waves may be disturbed by the ground, so it is difficult to stably perform wireless communication.

When the wireless communication module is placed and held on the ground, an antenna thereof is preferably positioned to face the sky to perform stable wireless communication for securing blasting accuracy. However, a wireless communication module of a current electronic detonation device has only one antenna positioned in an upper portion or a lower portion of a module housing, so it is difficult to hold the wireless communication module on the ground so that the antenna is positioned to face the sky.

DISCLOSURE

Technical Problem

Accordingly, the present disclosure has been made keeping in mind the above problems occurring in the prior art, and an objective of the present disclosure is to provide an electronic detonation device with a dual antenna for a blasting system and a blasting system using the same, wherein the electronic detonation device has a wireless communication module in which an antenna is positioned in each of an upper portion and a lower portion of a module housing, so that stable wireless communication is possible regardless of a placement direction of the wireless communication module on the ground.

Another objective of the present invention is to provide an electronic detonation device with a dual antenna for a blasting system and a blasting system using the same, wherein the electronic detonation device has a wireless communication module held to be spaced apart from the ground, so that the stable wireless communication is performed regardless of a placement direction of the wireless communication module on the ground.

A further objective of the present disclosure is to provide an electronic detonation device with a dual antenna for a blasting system and a blasting system using the same, wherein an electronic detonator is held by a wireless communication module for easy storage and portability.

Technical Solution

In order to accomplish the above objective, the present disclosure provides an electronic detonation device with the dual antenna for a blasting system. The electronic detonation device with the dual antenna for a blasting system includes: an electronic detonator and a wireless communication module; and a wire part configured to connect the electronic detonator to the wireless communication module, wherein the wireless communication module may include a first antenna part positioned in an upper portion therein and a second antenna part positioned in a lower portion therein.

The wireless communication module may include: a communication module housing part; and the antenna parts positioned in the communication module housing part; and a wireless communication controller configured to control operation of the electronic detonator by signals transmitted from the antenna parts.

The wireless communication module may further include: an antenna switch part configured to selectively connect either of the first antenna part and the second antenna part to the wireless communication controller.

The antenna switch part may be configured to select an antenna part with high signal strength among the first antenna part and the second antenna part and to transmit the signal from the selected antenna part to the wireless communication controller.

In the communication module housing part, the first antenna part may be positioned to be in close contact with an upper surface of the communication module housing part and the second antenna part may be positioned to be in close contact with a lower surface thereof.

A plurality of housing support protrusions may be positioned on each of an upper surface and a lower surface of the communication module housing part, so that the communication module housing part may be spaced apart from ground.

The housing support protrusions may be positioned with an interval in which the electronic detonator may be fitted, so that the electronic detonator may be stored while being fitted in the interval.

Each of the housing support protrusions may be configured to have a height at least equal to or higher than a diameter or a maximum thickness of the electronic detonator.

Each of the housing support protrusions may include: a first supporting jig member and a second supporting jig member that may be configured to clamp and hold the electronic detonator by being moved in facing directions or opposite directions; and a jig moving part positioned in the communication module housing part and configured to move the first supporting jig member and the second supporting jig member in the facing directions or opposite directions.

The first supporting jig member and the second supporting jig member may include respective elastic pad members on facing surfaces thereof.

The housing support protrusions may further include a detonator position detecting sensor that may detect that the electronic detonator may be positioned between the first supporting jig member and the second supporting jig member.

A pressure detecting sensor, which may detect pressure when the electronic detonator is fitted between the first supporting jig member and the second supporting jig member, may be positioned in at least one of the first supporting jig member and the second supporting jig member, and when the pressure detecting sensor detects a pre-set pressure value, movements of the first supporting jig member and the second supporting jig member may be stopped.

Each of the first supporting jig member and the second supporting jig member may have a traveling wheel member that may be rotatably positioned and protrudes downward.

A blasting system may include: an electronic detonation device for the blasting system; and a user terminal that may wirelessly communicate with the electronic detonation device for the blasting system through wireless communication and control operation of the electronic detonation device for the blasting system, wherein the electronic detonation device for the blasting system is an embodiment of the electronic detonation device with a dual antenna for a blasting system.

Advantageous Effects

According to the present disclosure, the antenna of the wireless communication module is positioned in each of the upper portion and the lower portion of the module housing part. Accordingly, blasting accuracy can be improved by enabling stable wireless communication regardless of a placement direction of the wireless communication module on the ground.

According to the present disclosure, the wireless communication module is held to be spaced apart from the ground and an antenna with the highest signal strength among the two antennas is selected for communication. Therefore, stable wireless communication can be performed regardless of a placement direction of the wireless communication module on the ground, and the blasting accuracy and stability can be secured at the same time.

According to the present disclosure, the electronic detonator is held by the wireless communication module for easy storage and portability. Therefore, convenience in use and convenience in storage can be secured at the same time.

DESCRIPTION OF DRAWINGS

FIG. 1 is a view showing an electronic detonation device with a dual antenna for a blasting system and a blasting system using the electronic detonation device according to an embodiment of the present disclosure;

FIG. 2 is a view schematically showing a first embodiment of a wireless communication module of the electronic detonation device with the dual antenna for a blasting system and the blasting system using the electronic detonation device according to the present disclosure;

FIG. 3 is a bottom perspective view showing a second embodiment of the wireless communication module of the electronic detonation device with the dual antenna for a blasting system and the blasting system using the electronic detonation device according to the present disclosure;

FIG. 4 is a view schematically showing a third embodiment of the wireless communication module of the electronic detonation device with the dual antenna for a blasting system and the blasting system using the electronic detonation device according to the present disclosure;

FIG. 5 is a block diagram showing an embodiment of the blasting system using the electronic detonation device with the dual antenna for a blasting system according to the present disclosure;

FIG. 6 is a block diagram showing an embodiment of a user terminal of the blasting system using the electronic detonation device with the dual antenna for a blasting system according to the present disclosure; and FIG. 7 is a use example of the electronic detonation device with the dual antenna for a blasting system according to the present disclosure.

DESCRIPTION OF REFERENCE NUMERALS

100: electronic detonator
200: wireless communication module
210: communication module housing part
220: first antenna part
230: second antenna part
240: wireless communication controller
250: antenna switch part
300: wire part
400: housing support protrusion
410: first supporting jig member
420: second supporting jig member
430: jig moving part
440: detonator position detecting sensor
450: elastic pad member
460: traveling wheel member

BEST MODE

Hereinafter, the present disclosure will be described in detail.

Exemplary embodiments of the present disclosure will be described in detail with reference to the accompanying drawings as follows. Prior to the detailed description of the present disclosure, all terms or words used in the description and claims should not be interpreted as being limited merely to common and dictionary meanings. Meanwhile, the embodiments described in the specification and the configurations illustrated in the drawings are merely examples, and do not exhaustively present the technical spirit of the present disclosure. Accordingly, it should be appreciated that there may be various equivalents and modifications that can replace the embodiments and the configurations at the time at which the present application is filed.

FIG. 1 is a perspective view showing an embodiment of an electronic detonation device with a dual antenna for a blasting system according to the present disclosure. FIG. 2 is a view schematically showing a first embodiment of a wireless communication module of the electronic detonation device with the dual antenna for a blasting system and a blasting system using the electronic detonation device according to the present disclosure.

Referring to FIGS. 1 and 2, the electronic detonation device with the dual antenna for a blasting system according to the first embodiment includes an electronic detonator 100, a wireless communication module 200, and a wire part 300 connecting the electronic detonator 100 to the wireless communication module 200.

The electronic detonator 100 stores detonator information and is detonated in response to a blast command to explode an explosive.

The wire part 300 may be wound or folded several times and then stored using a wire band or a wire tie, and may be unfolded when in use.

The wire part 300 may be implemented as various shapes using known electric wires for communication, and a detailed description thereof will be omitted.

The wireless communication module 200 includes a communication module housing part 210 an antenna part positioned in the communication module housing part 210, and a wireless communication controller 240 controlling operation of the electronic detonator 100 by a signal transmitted from the antenna.

As an example, the communication module housing part 210 may have a donut shape in which a hollow part is positioned in the center thereof. The communication module housing part 210 may have a space to receive the wireless communication controller 240 controlling the operation of the electronic detonator 100 by a signal transmitted from the antenna, that is, the antenna part.

In more detail, the wireless communication module 200 may include: a first antenna part 220 positioned at an upper portion in the communication module housing part 210; a second antenna part 230 positioned to be spaced apart from a lower side of the first antenna part 220 in the communication module housing part 210; and the wireless communication controller 240 controlling the operation of the electronic detonator 100 by a signal transmitted from the first antenna part 220 or the second antenna part 230.

Furthermore, the wireless communication module 200 may include an antenna switch part 250 selectively connecting any one of the first antenna part 220 and the second antenna part 230 to the wireless communication controller 240.

The antenna switch part 250 selects an antenna with high signal strength among the first antenna part 220 and the second antenna part 230 and transmits a signal from the selected antenna to the wireless communication controller 240.

The first antenna part 220 is positioned to be in close contact with an upper surface of the communication module housing part 210, and the second antenna part 230 is positioned to be in close contact with a lower surface of the communication module housing part 210, thereby maximally securing the intervals and maximizing the distance between the second antenna part 230 and the upper surface of the communication module housing part 210, and maximizing the distance between the first antenna part 220 and the lower surface of the communication module housing part 210.

Accordingly, when the upper surface of the communication module housing part 210 is seated on the ground, the second antenna part 230 may be located to face the sky with the maximum distance from the ground. On the other hand, when the lower surface of the communication module housing part 210 is seated on the ground, the first antenna part 220 may be located to face the sky with the maximum distance from the ground.

Using a means such as an automatic signal recognition chip or a packet internet grouper (PING), the wireless communication controller 240 or the antenna switch part 250 may select an antenna with high signal strength among the first antenna part 220 and the second antenna part 230 and receive a signal from the selected antenna.

Regardless of whether or not the upper surface or the lower surface of the communication module housing part 210 is seated on the ground, the wireless communication module 200, any one of the first antenna part 220 and the second antenna part 230 may be positioned toward the sky at the upper portion of the wireless communication module 200 and may be stably communicated in wireless manner with a user terminal.

Meanwhile, a plurality of housing support protrusions 400, which is provided to separate the communication module housing part 210 from the ground, is positioned in each of the upper surface and the lower surface of the communication module housing part 210.

The plurality of housing support protrusions 400 protrudes from the upper surface of the communication module housing part 210 at intervals, and the plurality of housing support protrusions 400 protrudes from the lower surface of communication module housing part 210 at intervals.

When the upper surface of the communication module housing part 210 is seated on the ground, the housing support protrusions 400 separate the upper surface thereof from the ground, so that the first antenna part 220 at the upper portion may receive a signal with high signal strength.

When the lower surface of the communication module housing part 210 is seated on the ground, the housing support protrusions 400 separates the upper surface thereof from the ground, so that the strength of a signal transmitted to the second antenna part 230 positioned on the upper surface thereof may be increased.

The housing support protrusions 400 are positioned with an interval in which the electronic detonator 100 is fitted, so that the electronic detonator 100 is stored while being fitted in the interval.

The housing support protrusions 400 may be made of elastic materials, such as urethane, synthetic rubber, and silicone, so that the electronic detonator 100 may be stably fitted therein and may be stored with safer protection from external impact.

As the electronic detonator according to the present disclosure is held by the wireless communication module 200, storage and portability of the electronic detonator become easy, and thus convenience in use and storage may be secured.

Each of the housing support protrusions 400 is configured to have a height that is at least equal to or higher than a diameter or the maximum thickness of the electronic detonator 100, so that the electronic detonator 100 fitted between the housing support protrusions 400 may be positioned to be stably held without being in contact with the ground.

Meanwhile, FIG. 3 is a bottom perspective view showing a second embodiment of the wireless communication module 200 of the electronic detonation device with the dual antenna for a blasting system and the blasting system using the electronic detonation device according to the present disclosure. FIG. 4 is a view schematically showing a third embodiment of the wireless communication module 200 of the electronic detonation device with the dual antenna for a blasting system and the blasting system using the electronic detonation device according to the present disclosure.

Referring to FIGS. 3 and 4, each of the housing support protrusions 400 includes: a first supporting jig member 410 and a second supporting jig member 420 that clamp and hold the electronic detonator 100 by being moved in facing directions or opposite directions; and a jig moving part 430 positioned in the communication module housing part 210 and moving the first supporting jig member 410 and the second supporting jig member 420 in the facing directions or the opposite directions.

The first supporting jig member 410 and the second supporting jig member 420 serve to separate the position of the communication module housing part 210 from the ground, and at the same time, the first supporting jig member 410 and the second supporting jig member 420 are moved in the facing directions to clamp the electronic detonator 100, so that the electronic detonator 100 may be held on each of the upper surface and the lower surface of the communication module housing part 210.

The first supporting jig member 410 and the second supporting jig member 420 have respective V-shaped groove parts on facing surfaces thereof, so that the electronic detonator 100 with a different diameter is stably held.

The first supporting jig member 410 and the second supporting jig member 420 have respective elastic pad members 450 on the facing surfaces thereof. Therefore, when the first supporting jig member 410 and the second supporting jig member 420 clamp and hold the electronic detonator 100, the electronic detonator 100 may be prevented from being damaged and may be stably clamped and held. In addition, when an impact occurs with the wireless communication module 200 while the electronic detonator 100 is held, the elastic pad members 450 absorb the impact so that the electronic detonator 100 may be stored in a safer state.

The housing support protrusions 400 are positioned as the pair facing each other, so that the rod-shaped electronic detonator 100 may be clamped in two places in a longitudinal direction to be stably held.

On each of the upper surface and the lower surface of the communication module housing part 210, a plurality of housing support protrusions 400 is arranged as a pair facing each other to be spaced apart from another pair of housing support protrusions 400 in a circumferential direction of the communication module housing part 210. Accordingly, the rod-shaped electronic detonator 100 may be supported in various directions, thereby increasing convenience in holding the electronic detonator 100.

Further, the housing support protrusions 400 may include a detonator position detecting sensor 440 detecting that the electronic detonator 100 is positioned between the first supporting jig member 410 and the second supporting jig member 420.

For example, the detonator position detecting sensor 440 is a laser distance sensor positioned on the same line as the jig moving part 430 between the first supporting jig member 410 and the second supporting jig member 420. When the electronic detonator 100 is positioned at a position equal to or less than a pre-set distance, the detonator position detecting sensor 440 may detect that the electronic detonator 100 may be positioned between the first supporting jig member 410 and the second supporting jig member 420.

In addition to the laser distance sensor, the detonator position detecting sensor 440 may be another known sensor, which detects that the electronic detonator 100 is positioned to be held between the first supporting jig member 410 and the second supporting jig member 420, between the first supporting jig member 410 and the second supporting jig member 420.

A pressure detecting sensor may be positioned in at least any one of the first supporting jig member 410 and the second supporting jig member 420 to detect pressure when the electronic detonator 100 is held between the first supporting jig member 410 and the second supporting jig member 420. When the pressure detecting sensor detects a pre-set pressure value, movements of the first supporting jig member 410 and the second supporting jig member 420 are stopped.

The jig moving part 430 may include an un-holding switch part. When an operator presses or manipulates the un-holding switch part, the first supporting jig member 410 and the second supporting jig member 420 may be moved in opposite directions to each other.

Although not shown in the drawings, the jig moving part 430 may include a jig moving screw that is screwed through each of the first supporting jig member 410 and the second supporting jig member 420 in opposite directions, and a screw rotation motor rotating the jig moving screws clockwise or counterclockwise.

For example, through the first supporting jig member 410, the moving screw may be screwed in a left-screw direction, and through the second supporting jig member 420, the moving screw may be screwed in a right-screw direction. The screwing directions may be reversed.

The first supporting jig member 410 and the second supporting jig member 420 are screwed in directions opposite to each other by the respective jig moving screws. Accordingly, according to rotation directions of the moving screws, when the interval between the first supporting jig member 410 and the second supporting jig member 420 is narrowed as the first supporting jig member 410 and the second supporting jig member 420 are moved in the facing directions, the electronic detonator 100 is held, or when the interval therebetween is widened as the first supporting jig member 410 and the second supporting jig member 420 are moved in the opposite directions, the electronic detonator 100 may be released from being held.

Each of the first supporting jig member 410 and the second supporting jig member 420 may have a traveling wheel member 460 that is rotatably positioned and protrudes downward.

When the wireless communication module 200 is placed on the ground or a floor, the traveling wheel member 460 is seated on the ground or the floor to allow the first supporting jig member 410 and the second supporting jig member 420 to be easily moved in the facing directions or the opposite direction.

When the operator positions the electronic detonator 100 at a location between the first supporting jig member 410 and the second supporting jig member 420, the detonator position detecting sensor 440 detects the positioning of the electronic detonator 100 and the jig moving part 430 moves the first supporting jig member 410 and the second supporting jig member 420 in the facing directions or opposite directions, so that the electronic detonator 100 is held between the first supporting jig member 410 and the second supporting jig member 420.

When the pressure required for holding the electronic detonator 100 is equal to or higher than the pre-set pressure value, movements of the first supporting jig member 410 and the second supporting jig member 420 are stopped so that the electronic detonator 100 may be prevented from an accident occurring when the electronic detonator 100 is compressed to a pressure equal to or higher than a pre-set pressure.

When the electronic detonator 100 held between the first supporting jig member 410 and the second supporting jig member 420, as the operator presses or manipulates the un-holding switch part, the first supporting jig member 410 and the second supporting jig member 420 releases the electronic detonator 100 while being moved in the opposite directions.

In summary, the first supporting jig member 410 and the second supporting jig member 420 are positioned to protrude toward each of the upper surface and the lower surface of the communication module housing part 210 so as to separate the position of the wireless communication module 200 from the ground. In addition, the first supporting jig member 410 and the second supporting jig member 420 may be moved in the facing directions to hold the rod-shaped electronic detonator 100.

FIG. 5 is a block diagram showing a first embodiment of the blasting system using the electronic detonation device with the dual antenna for a blasting system according to the present disclosure. Referring to FIG. 5, the electronic detonator 100 may communicate wirelessly with a user terminal 500 through the wireless communication module 200 so as to synchronize automatically with the user terminal 500.

The electronic detonator 100 may communicate with the user terminal 500 using wired communication or wireless communication to receive detonation time information or to transmit identifier information and positioning information to the user terminal 500.

Detonator information may include detonation time information, blast delay time information, identifier information, and positioning information.

The electronic detonator 100 may receive a blast command from the user terminal 500 to explode an explosive. When the electronic detonator 100 starts to count a blast delay time included in the blast command and the counting is completed, that is, after the blast delay time, the electronic detonator 100 detonates and explodes the explosive.

The wireless communication module 200 may allow the user terminal 500 and the electronic detonator 100 to communicate wirelessly with each other over a wireless network.

The wireless network may perform wireless communication by using known wireless networks, such as mobile radio communication networks including long-term evolution (LTE), Bluetooth™, Wi-Fi, wireless broadband internet (WiBro), and long range network (LoRa).

The user terminal 500 may synchronize with the electronic detonator 100 to transmit detonation time information to the electronic detonator 100 or to receive the identifier information and the positioning information from the electronic detonator 100.

Further, the user terminal 500 may transmit respective blast commands including blast delay times to a plurality of electronic detonators 100.

FIG. 6 is a block diagram showing a first embodiment of the user terminal 500 of the blasting system using the electronic detonation device with the dual antenna for a blasting system according to the present disclosure.

Referring to FIGS. 1, 5, and 6, the first embodiment of the user terminal 500 of the blasting system using the electronic detonation device with the dual antenna for a blasting system will be described in detail.

The user terminal 500 may include a controller 510, a memory unit 520, a wireless communication unit 530, a display unit 550, and a bus unit 560.

The controller 510 may control the overall operation of the user terminal 500. According to the embodiment, the controller 510 may be implemented as a central processing unit (CPU), a microprocessing unit (MPU), a graphics processing unit (GPU), or the like.

The memory unit 520 may store a plurality of commands constituting a program that may be executed by the controller 510, components list data for a components list, and components property data indicating properties of components. Depending on the embodiment, the memory unit 520 may be implemented as read-only memory (ROM), random access memory (RAM), a hard disk drive (HDD), a solid-state drive (SSD), or the like.

The wireless communication unit 530 may perform communication between the user terminal 500 and the electronic detonator 100. For example, the wireless communication unit 530 may communicate with the wireless communication module 200 over a wireless network. According to the embodiment, the wireless communication unit 530 may use various types of wireless networks, such as mobile radio communication networks including long-term evolution (LTE), Bluetooth™, Wi-Fi, wireless broadband internet (WiBro), long range network (LoRa), etc., to perform communication.

The display unit 550 may display an image. For example, the display unit 550 may be implemented as a display panel. According to the embodiment, the display unit 550 may be implemented as any one of a liquid crystal display device), an organic light-emitting display device, and the like, but the present disclosure is not limited thereto, and the display unit 550 may be implemented as any of various devices as long as the display unit 550 serves the purpose of displaying an image. The display unit 550 may display the electronic detonator 100 on a map on the basis of the identifier information and the positioning information received from the electronic detonator 100.

The bus unit 560 may perform data transmission and reception between the controller 510, the memory unit 520, the wireless communication unit 530, and the display unit 550. Depending on the embodiment, the bus unit 560 may be implemented as a bus interface.

The controller 510 may include a time-setting module 511, a positioning module 512, an identification module 513, a delay-time-setting module 514, and a blasting module 515. In the specification, a module may be software (a program) in which the commands constituting the program stored in the memory unit 520 are executed by the controller 510.

The time-setting module 511 may set the detonation time corresponding to the electronic detonator 100.

When the user terminal 500 is synchronized with the electronic detonator 100, the time-setting module 511 may set the detonation time and transmit the detonation time information indicating the detonation time to the electronic detonator 100 through the wireless communication unit.

The positioning module 512 may check the position of the electronic detonator 100. When the user terminal 500 is synchronized with the electronic detonator 100, the positioning module 512 may receive the positioning information from the electronic detonator 100 through the wireless communication unit 530. Further, the positioning module 512 may check the position of the electronic detonator 100 using the positioning information.

The identification module 513 may detect an identifier by receiving the identifier information of the electronic detonator 100. When the user terminal 500 synchronizes with the electronic detonator 100, the identification module 513 may receive the identifier information from the electronic detonator 100 through the wireless communication unit 530. Further, the identification module 513 may identify the electronic detonator 100 using the identifier information.

The delay-time-setting module 514 may set the blast delay time corresponding to the electronic detonator 100. For example, the blast delay time may be set in consideration of a delay time and a stepped difference. When the user terminal 500 synchronizes with the electronic detonator 100, the delay-time-setting module 514 may set the blast delay time.

The blasting module 515 may transmit a blast command including the blast delay time set by the delay-time-setting module 514 to the electronic detonator 100. For example, the blasting module 515 may transmit the blast command to the electronic detonator 100 through the wireless communication unit 530. The electronic detonator 100 may store the blast delay time information indicating the blasting delay time included in the received blast command.

FIG. 7 is a view schematically showing a use example of the electronic detonation device with the dual antenna for a blasting system according to the present disclosure.

Referring to FIG. 7, the blasting system using the electronic detonation device with the dual antenna for a blasting system according to the present disclosure is configured to insert the electronic detonator 100 into a blasting hole provided in the ground and then to blast the electronic detonator 100 by communicating with the user terminal via wireless communication or wired communication.

The wireless communication module 200 is seated and held on the ground, and may be positioned to be spaced apart from the ground. Regardless of whether the upper surface or the lower surface is placed on the ground, the first antenna part 220 or the second antenna part 230 is positioned to face the sky, so that communication stability is secured.

According to the present disclosure, the antenna of the wireless communication module is positioned in each of the upper portion and the lower portion of the module housing part. Accordingly, the blasting accuracy is improved by enabling stable wireless communication regardless of a placement direction of the wireless communication module on the ground.

According to the present disclosure, the wireless communication module is held to be spaced apart from the ground and an antenna with the highest signal strength among the two antennas is selected for communication. Therefore, stable wireless communication may be performed regardless of a placement direction of the wireless communication module on the ground, and the blasting accuracy and stability may be secured at the same time.

According to the present disclosure, the electronic detonator is held to the wireless communication module for easy storage and portability, thereby securing convenience in use and convenience in storage at the same time.

The present disclosure is not limited to the above-described embodiments, and may be implemented as various modifications, additions and substitutions without departing from the scope and spirit of the present disclosure as disclosed in the accompanying claims, and the modifications and the like are included in the configuration of the present disclosure.

The invention claimed is:

1. An electronic detonation device with a dual antenna for a blasting system, the electronic detonation device comprising:

an electronic detonator and a wireless communication module; and a wire part configured to connect the electronic detonator to the wireless communication module, wherein the wireless communication module comprises:

a first antenna part positioned in an upper portion therein and a second antenna part positioned in a lower portion therein;

a communication module housing part;

the antenna parts positioned in the communication module housing part;

a wireless communication controller configured to control operation of the electronic detonator by signals transmitted from the antenna parts; and an antenna switch part configured to selectively connect either of the first antenna part and the second antenna part to the wireless communication controller.

2. The electronic detonation device of claim 1, wherein the antenna switch part is configured to select an antenna part with higher signal strength among the first antenna part and the second antenna part and to transmit the signal from the selected antenna part to the wireless communication controller.

3. The electronic detonation device of claim 1, wherein, in the communication module housing part, the first antenna part is positioned to be in contact with an upper surface of the communication module housing part and the second antenna part is positioned to be in contact with a lower surface thereof.

4. The electronic detonation device of claim 1, wherein a plurality of housing support protrusions is positioned on each of an upper surface and a lower surface of the communication module housing part, so that the communication module housing part is spaced apart from ground.

5. The electronic detonation device of claim 4, wherein each of the housing support protrusions is configured to have a height that is at least equal to or higher than a diameter or a maximum thickness of the electronic detonator.

6. The electronic detonation device of claim 4, wherein each of the housing support protrusions comprises:

a first supporting jig member and a second supporting jig member that are configured to clamp and hold the electronic detonator by being moved in facing directions or opposite directions; and a jig moving part positioned in the communication module housing part and configured to move the first supporting jig member and the second supporting jig member in the facing directions or opposite directions.

7. The electronic detonation device of claim 6, wherein the first supporting jig member and the second supporting jig member comprises respective elastic pad members on facing surfaces thereof.

8. The electronic detonation device of claim 6, wherein the housing support protrusions further comprise a detonator position detecting sensor that detects that the electronic detonator is positioned between the first supporting jig member and the second supporting jig member.

9. The electronic detonation device of claim 6, wherein each of the first supporting jig member and the second supporting jig member has a traveling wheel member that is rotatably positioned and protrudes downward.

10. A blasting system comprising:

an electronic detonation device for the blasting system; and a user terminal that wirelessly communicates with the electronic detonation device for the blasting system through wireless communication and controls operation of the electronic detonation device for the blasting system, wherein the electronic detonation device for the blasting system is an electronic detonation device with a dual antenna for a blasting system of claim 1.

* * * * *